US007678204B2

(12) United States Patent
Katsumi et al.

(10) Patent No.: US 7,678,204 B2
(45) Date of Patent: Mar. 16, 2010

(54) GOOD-WORKABILITY AND HIGH-STRENGTH COLD-ROLLED STEEL SHEET EXCELLENT IN POST-PAINTING CORROSION RESISTANCE

(75) Inventors: Toshiyuki Katsumi, Kimitsu (JP); Kazuhiko Honda, Kimitsu (JP); Koki Tanaka, Futtsu (JP); Kaoru Yamazaki, Tokyo (JP); Takahiro Tanae, Wako (JP); Katsuyoshi Kaneko, Wako (JP); Yoshikazu Umeno, Wako (JP); Yoshitaka Okitsu, Wako (JP)

(73) Assignees: Nippon Steel Corporation, Tokyo (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/732,336

(22) Filed: Dec. 9, 2003

(65) Prior Publication Data

US 2004/0144452 A1 Jul. 29, 2004

(30) Foreign Application Priority Data

Dec. 10, 2002 (JP) ..... 2002-357547

(51) Int. Cl.
*C22C 38/14* (2006.01)

(52) U.S. Cl. ..... 148/307; 148/308; 148/902; 420/87; 420/120

(58) Field of Classification Search ..... 148/320, 148/537, 534, 307, 308, 902; 420/87, 120
See application file for complete search history.

(56) References Cited

U.S. PATENT DOCUMENTS 6,436,555 B1 * 8/2002 Nakajima et al. ..... 428/659
6,527,876 B2 * 3/2003 Namikawa et al. ..... 148/307

FOREIGN PATENT DOCUMENTS

| | | | | |
|---|---|---|---|---|
| JP | S52-52115 | | 4/1977 | |
| JP | S52-69813 | | 6/1977 | |
| JP | 1430114 | | 3/1988 | |
| JP | 1177687 | | 7/1989 | |
| JP | 404128320 | * | 4/1992 | |
| JP | 404254562 | * | 9/1992 | ..... 148/533 |
| JP | H5-55570 | | 3/1993 | |
| JP | H5-70556 | | 3/1993 | |
| JP | 1925458 | | 4/1995 | |
| JP | H10-280087 | | 10/1998 | |
| JP | 2001295017 | * | 10/2001 | |

* cited by examiner

*Primary Examiner*—Sikyin Ip
(74) *Attorney, Agent, or Firm*—Kenyon & Kenyon LLP

(57) ABSTRACT

The present invention: provides a good-workability and high-strength cold-rolled steel sheet excellent in post-painting corrosion resistance to the extent of securing excellent resistance to salt warm water immersion which is a good-workability and high-strength cold-rolled steel sheet excellent in post-painting corrosion resistance characterized in that: said steel sheet contains, in mass, 0.16 to 0.19% C, 1.10 to 1.30% Si, 1.50 to 1.60% Mn, not more than 0.1% P and 0.015 to 0.050% Al, with the balance consisting of Fe and unavoidable impurities; the average of the amount of Si incrassating on the surface of said steel sheet is not more than 20 times the Si concentration in said steel sheet; and the area percentage of the portions where the ratio of the Si concentration on the surface of said steel sheet to the Si concentration in said steel sheet is not less than 10 is not more than 95%.

1 Claim, 7 Drawing Sheets

INVENTION EXAMPLE

COMPARATIVE EXAMPLE

GOOD-WORKABILITY AND HIGH-STRENGTH COLD-ROLLED STEEL SHEET EXCELLENT IN POST-PAINTING CORROSION RESISTANCE

BACKGROUND OF THE INVENTION

1. Field of the Invention

The present invention relates to a high-strength cold-rolled steel sheet excellent in post-painting corrosion resistance.

2. Description of the Related Art

In recent years, a reduction in car body weight has increasingly been demanded, with the aim of improving collision safety and fuel consumption, in the automobile industry and a further enhanced strength has been demanded for a steel sheet that is one of the major component materials of a car body.

In particular, such a steel material is required to have, together with strength, press-formability that can cope with a complicated shape.

As prior arts that meet such requirements, for example, Japanese Patent No. 1177687, Japanese Unexamined Patent Publications No. S52-52115 and No. S52-69813 and others disclose a high-ductility high-tensile-strength steel sheet produced by complexly adding Si, Mn, etc.

Further, the phenomenon of generating strain-induced transformation of retained austenite and showing a large elongation in the event of: subjecting a low carbon steel to which Si and Mn are complexly added to an overaging treatment after two-phase zone annealing; changing a part of austenite to bainite; and finally forming a structure composed of ferrite, bainite and retained austenite, the so-called TRIP phenomenon, has been found recently. As technologies that make use of such a TRIP phenomenon, Japanese Patents No. 1925458 and No. 1430114, Japanese Unexamined Patent Publication No. H5-70556, and others, have been disclosed.

Furthermore, as the existence of elements such as C and Si, that are used in a high-strength steel sheet, deteriorate the surface quality of the steel sheet, as technologies to solve the problem, Japanese Examined Patent Publication No. H5-55570, Japanese Unexamined Patent Publication No. H10-280087 and others have been disclosed.

SUMMARY OF THE INVENTION

As the result of such efforts, the application of high-tensile-strength steel sheets to automobiles is increasing and, with regard to the strength of applied steel sheets, whereas steel sheets of the 440 Mpa class, that was regarded as the upper limit, were used in the past, those of the 590 Mpa class are mass-produced and applied at present and, further, the application of steel sheets having a higher strength is being addressed.

In the meantime, as one of the important properties required of a steel sheet for an automobile, there is the rust prevention property of a steel sheet applied to a car body. Such rust prevention of a car body is secured not by a steel sheet itself but by the combination thereof with chemical treatment and painting. As properties of a steel sheet, particularly the surface quality of a steel sheet, are influence not only chemical treatment and the like but also by corrosion resistance, a steel sheet is required to have a high strength while securing such a surface quality.

In view of the above situation, the object of the present invention is to provide a good-workability and high-strength cold-rolled steel sheet excellent in post-painting corrosion resistance to the extent of securing excellent resistance to warm salt-water immersion without the deterioration of the strength and workability of the steel sheet.

As methods of evaluating the corrosion resistance of a steel sheet, evaluation methods using various accelerated tests, in addition to a vehicle-running test, are widely adopted. It is important that an accelerated test can closely simulate actual corrosion and has the capability of evaluating corrosion in as short a period of time as possible and a corrosion cycle test (CCT) is currently adopted by automakers as a main evaluation method. However, even by such a method, it takes at least one to two months for the evaluation. While the development of a new automobile in a short period of time is required, in particular, the shortening of the time required for the evaluation of a material is regarded as an unavoidable challenge. A warm salt-water immersion test employed by some automakers is a method that allows evaluation at a relatively short period of time. The evaluation method comprises the steps of: applying chemical and electrodeposition treatments to a steel material; thereafter applying scratches that reach the substrate with a cutter; dipping the scratched steel material into salt water for ten days at 55° C.; and evaluating the width of the paint film blistering from the scratches. Therefore, the features of the evaluation method are that the evaluation is performed under severe conditions and that the evaluation time is ten days; less than one-third of CCT.

To cope with the aforementioned requirements for the enhancement of the strength of a steel sheet, the present inventors studied and evaluated variously the application of a 780 Mpa class high-strength steel sheet to an automobile and confirmed that such a steel sheet showed a large paint film blistering width originated from scratches and did not fulfill the requirements of customers.

The present inventors investigated the causes that made the relevant steel sheet unsatisfactory for the required properties, earnestly studied the problem, and reached the following findings. The gist of the present invention is a good-workability and high-strength cold-rolled steel sheet excellent in post-painting corrosion resistance characterized in that: said steel sheet contains, in mass, 0.16 to 0.19% C, 1.10 to 1.30% Si, 1.50 to 1.60% Mn, not more than 0.1% P and 0.015 to 0.050% Al, with the balance consisting of Fe and unavoidable impurities; the average of the amount of Si incrassating on the surface of said steel sheet is not more than 20 times the Si concentration in said steel sheet; and the area percentage of the portions where the ratio of the Si concentration on the surface of said steel sheet to the Si concentration in said steel sheet is not less than 10 is not more than 95%.

DESCRIPTION OF THE PREFERRED EMBODIMENTS

Figure 1:
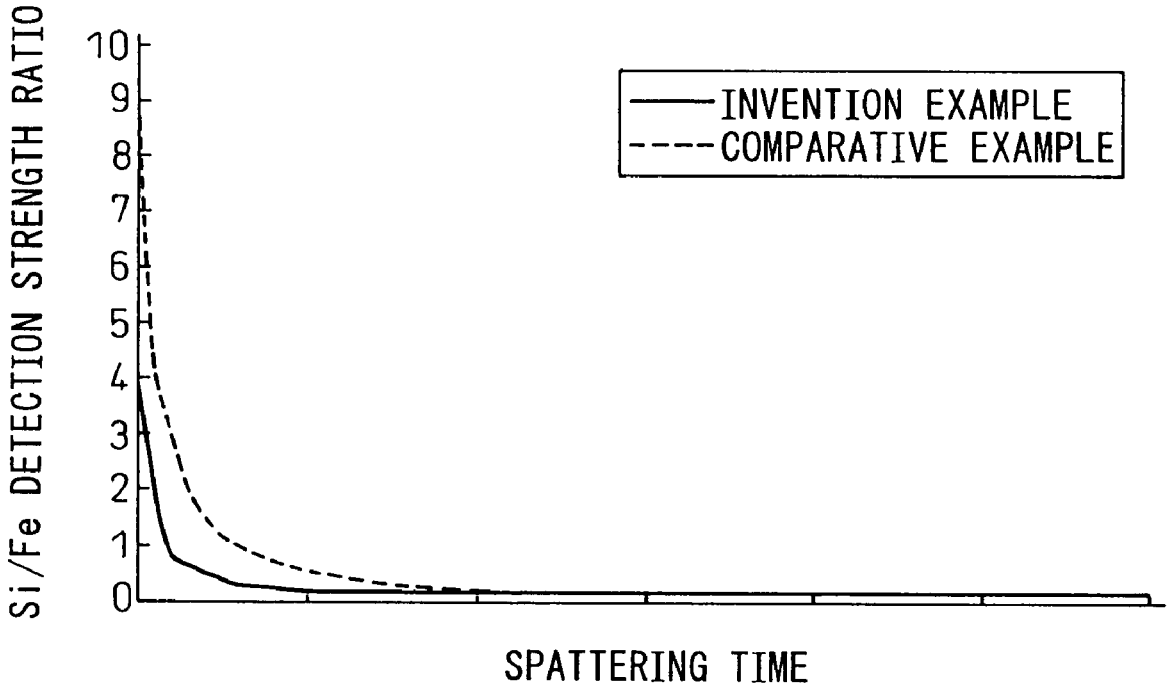
FIG. 1 is a graph showing the state of Si incrassating on the surface of each steel sheet (GDS analysis result).

As a factor influencing such corrosion resistance after chemical treatment and electrodeposition painting, adding Si to steel is generally known. It is said that particularly Si incrassating in a surface layer causes chemical treatment to be hindered, an uneven chemical film to be formed, and the portions where chemical films are not formed, called see-through defects, to be generated, and therefore deteriorates not only paint film adhesiveness but also post-painting corrosion resistance.

In view of the above situation, firstly the concentration of Si in steel was studied.

It has been confirmed that the ranges of components effective for securing a strength of 780 Mpa class while securing such features of TRIP as explained above are 0.16 to 0.18% C, 1.6 to 1.8% Si and 0.14 to 0.16% Mn. However, in such component ranges, salt warm water immersion resistance cannot be secured as it has been explained earlier. Further, the decrease of the concentration of Si in steel to not more than 1.0% allows salt warm water immersion resistance to be secured, but makes it impossible to secure a required strength.

The increase of Mn and C concentrations instead of the decrease of an Si concentration makes it possible to compensate the lowering of strength to some extent. However, the increase of the concentrations of such elements is limited in consideration of the balance between strength and workability, weldability and the like. Therefore, when a strength of 780 Mpa, workability and weldability are required to be maintained simultaneously, the lower limit of an Si concentration is at least 1.1 to 1.3% even though Mn and C concentrations are increased to their upper limits. In this component configuration, salt warm water immersion resistance tends to improve in comparison with a conventional component configuration but does not reach a sufficient level. Here, with regard to chemical treatment films of steel sheets that had caused such problems, the present inventors investigated again deposit amounts that were regarded as an index of the properties of a chemical treatment film, crystal shapes, crystal sizes, see-through defects, and P ratios. As a result, the present inventors confirmed that, in the case of the steel sheets inferior in salt warm water immersion resistance, initially assumed chemical treatment defects were not observed and that no difference, from good ordinary steels, in chemical film quality was observed.

From the above results, it is estimated that the inferiority in salt warm water immersion resistance, which is the current subject to be solved, is caused not by the defects of a chemical film that has been recognized as the cause but by other factors.

In view of such phenomena, the present inventors earnestly repeated studies, investigated the mechanism of deteriorating the properties in salt warm water immersion tests, identified Si oxide incrassating unevenly on a surface as the cause, and found that an excellent salt warm water immersion resistance could be obtained by suppressing and uniformalizing the incrassation of Si on a surface.

Specifically, the mechanism of corrosion in the vicinity of a cut portion in a salt warm water immersion test is called alkali blistering and it is estimated that: $Fe^{2+}$ liquates with metal exposed at a cut portion acting as an anode; a local battery that generates $OH^-$ is formed with a portion under a paint film in the vicinity of the cut portion acting as a cathode; pH is raised by $OH^-$ generated under the paint film; resultantly a chemical film dissolves; water molecules and $Na^{2+}$ intrude by an osmotic pressure; and thus paint film blistering advances.

In the case of a TRIP type high-strength steel sheet to be addressed here, Si and Mn are added thereto in high concentrations. It has been pointed out that those elements incrassate on the surface of a steel sheet by selective oxidization in an annealing process. However, the elements do not necessarily incrassate uniformly on the surface of a steel sheet. According to the investigation by the present inventors, it has been confirmed that Si oxide exists unevenly on the surface of a steel sheet after annealing (see FIGS. 1 to 3).

A specific resistance of $SiO_2$, which is a typical Si oxide, is in the order of about the 20th power of 10 times that of iron and the electric resistance of a steel sheet surface varies largely in accordance with the concentration of Si oxide existing on the steel sheet surface. Such an uneven Si oxide existing on a steel sheet surface hinders electrons from flowing uniformly in corrosion reaction and the reaction converges at a portion of a low Si oxide concentration. Therefore, an $OH^-$ concentration at the portion increases, pH rises locally, the dissolution of a chemical film and the intrusion of water molecules and $Na^{2+}$ are accelerated, and, as a result, the blister width expands.

For that reason, it is made possible to prevent the local rise of pH under a paint film and narrow a blister width by lowering the incrassation of Si oxide on a steel sheet surface and making the distribution thereof uniform.

Figure 4:
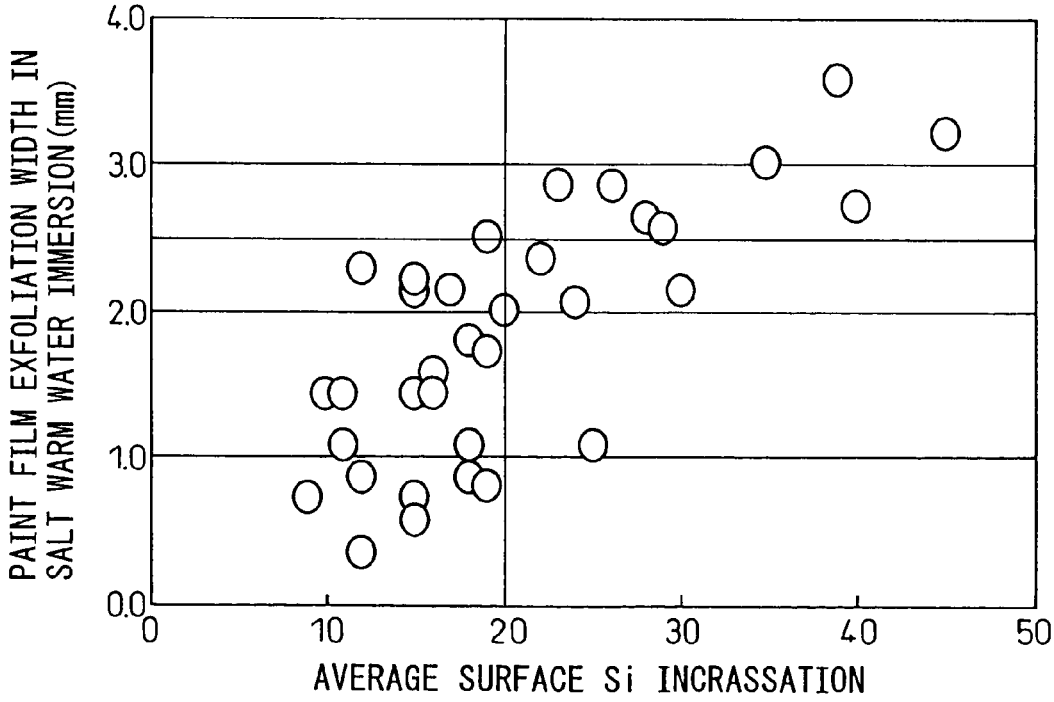
FIG. 4 is a graph showing the relationship between average surface incrassation amounts and paint film exfoliation widths in salt warm water immersion tests.
Figure 5:
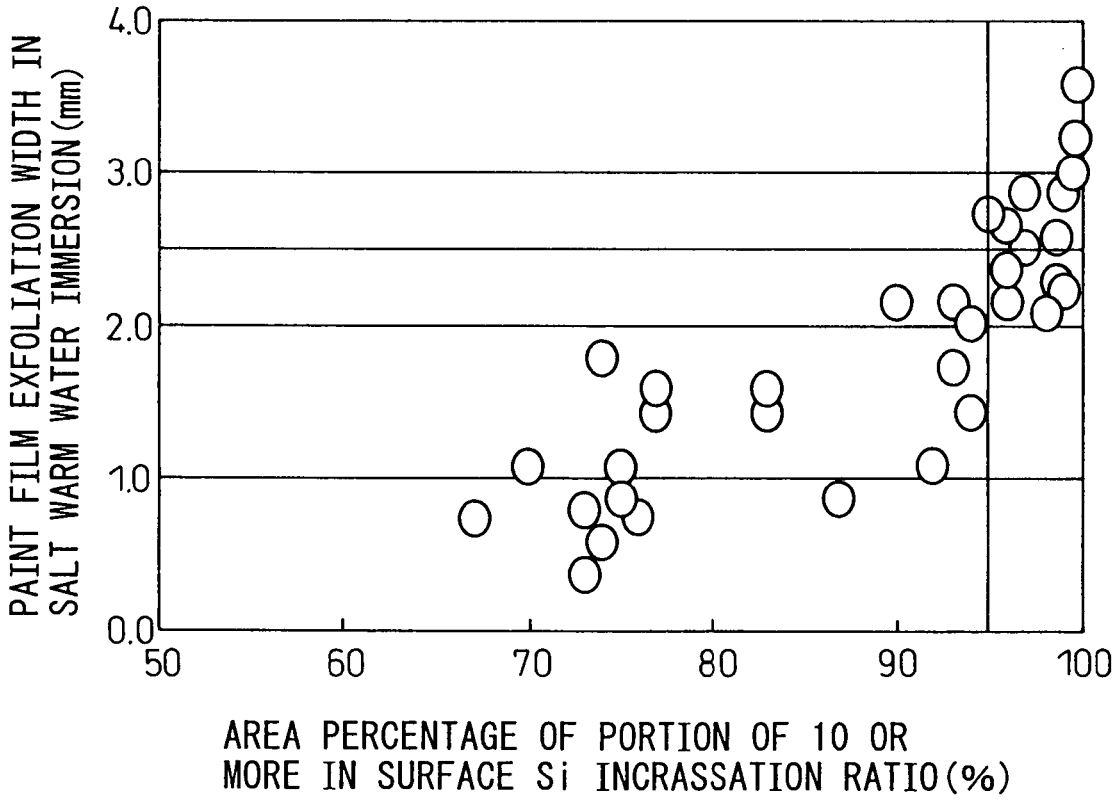
FIG. 5 is a graph showing the relationship between surface Si distribution states and paint film exfoliation widths in salt warm water immersion tests.

With regard to the amount of Si incrassating on a surface necessary for securing good properties, it has been confirmed through investigations by the present inventors that good properties are secured on condition that: the average of the amount of Si incrassating on a surface is not more than 20 times an Si concentration in steel; and the area percentage of the portions where the ratio of the Si concentration on the surface to the Si concentration in the steel is not less than 10 is not more than 95% (see FIGS. 4 and 5).

FIG. 1 shows, as an example, the result of measuring the states of Si incrassating on the surfaces of an invention example and a comparative example. The figure shows the ratios of Si detection strengths to Fe detection strengths measured in the depth direction by GDS. In either of the cases, the Si incrassation on the steel sheet surface is confirmed in comparison with the strength ratio of the interior of the steel. Further, it is understood that, whereas the amount of Si incrassating on the surface reaches 40 to 50 times the Si concentration in the steel in the case of the conventional steel sheet, the same is not more than 20 times in the case of the steel sheet of the invention. In addition, the present inventors analyzed the steel sheet surfaces by XPS and AES and obtained the same results.

Further, with regard to a method for controlling Si incrassating on a surface, specifically the control factors include elements added to steel, reheating furnace temperature conditions in a hot-rolling process, descaling conditions in the same hot-rolling process, methods of polishing and pickling a steel sheet surface, and the control conditions of an atmosphere in an annealing process, control is carried out by employing those control factors individually or in combination.

With regard to chemical components, when an Si amount is 1.30 mass % or more, a good result is hard to obtain even though other conditions are properly adjusted. On the other hand, when an Si amount is not more than 1.10 mass %, a prescribed strength is hard to obtain.

With regard to reheating furnace temperature conditions in hot rolling, a reheating furnace temperature of 1,200° C. or higher is necessary for incrassating Si in a surface layer beforehand and thereafter removing the incrassated Si by descaling or other means and a preferable reheating furnace temperature is 1,240° C. or higher.

A preferable descaling method in a hot-rolling process is descaling by high-pressure water, the so-called high-pressure descaling process.

With regard to pickling conditions, it is desirable to apply pickling including pickling in a tank containing hydrochloric acid 6% or more in concentration, and it is further desirable if the aforementioned pickling is applied twice for perfect descaling.

Figure 2A:
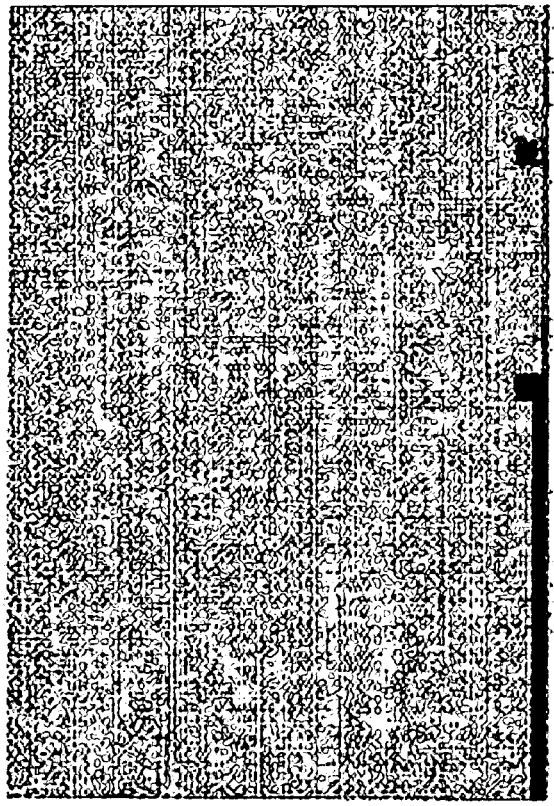
FIG. 2 is photographs by CMA showing the states of Si distributing on the surfaces of steel sheets.
Figure 2B:
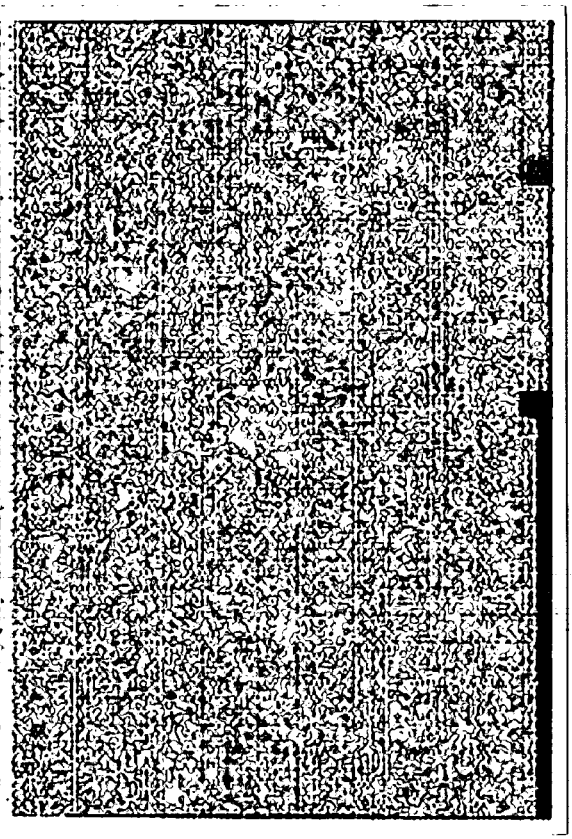
Figure 3:
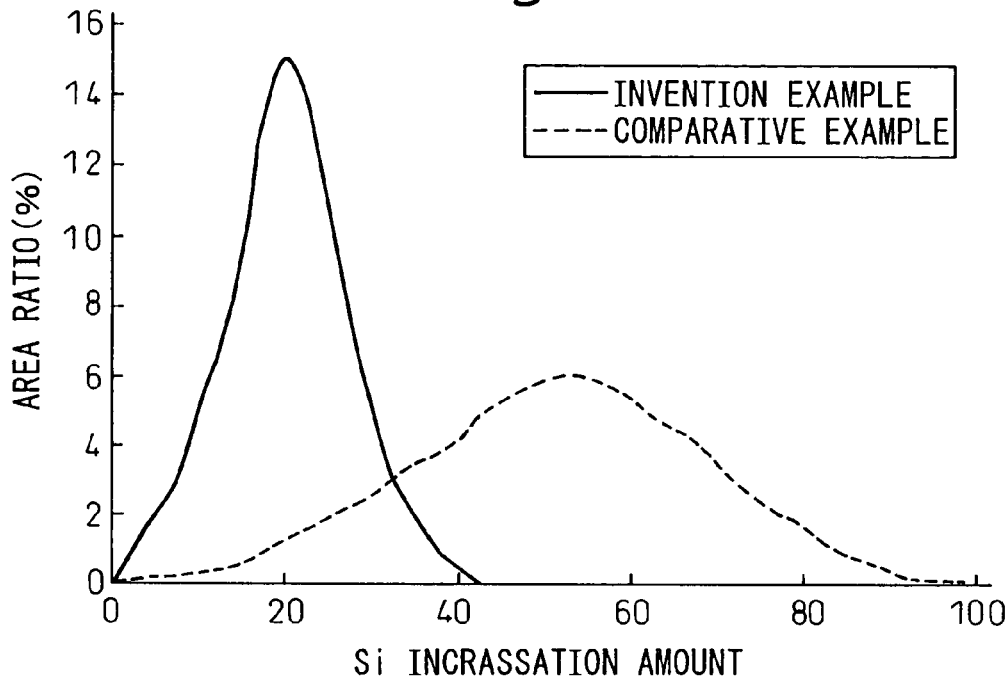
FIG. 3 is a graph by CMA showing the image of the distribution of the amount of Si incrassating on the surface of each steel sheet.

FIG. 2 shows, as an example, the analysis results of Si on the steel sheet surfaces of the invention example and the comparative example by CMA, and FIG. 3 the concentration distributions on the basis of the same analysis results. In the CMA analysis, the diameter of the measurement beam was reduced up to 1μ and the measurement was carried out at a pitch of 1μ at 250 points×500 points. From FIG. 2, it is confirmed that, whereas the Si distribution is uneven and the low concentration portions are scattered in the case of the conventional steel sheet, the concentration is generally low and the dispersion is small in the case of the invention steel sheet. Further, from the concentration distribution shown in FIG. 3 too, it is confirmed that the Si concentration distribution is in a narrow range and uniform in the case of the invention steel sheet.

FIGS. 4 and 5 show the relationships between average surface Si incrassation amounts and the widths of paint films exfoliating from cut portions in salt warm water immersion tests and between surface Si distribution states and the same paint film exfoliation widths, respectively. Here, with regard to the concentration distribution, the relationship between the area percentages of the portions where the incrassation amounts are not less than 10 times the concentrations in steel and the exfoliation widths was studied.

Here, in the implementation of the salt warm water immersion tests, any of a degreasing agent, a surface modifier, a chemical treatment agent and a electrodeposition paint used here was a product of Nippon Paint Co., Ltd.; the degreasing agent: SURF Cleaner SD250, the surface modifier: SURF Fine 5N-10, the chemical treatment agent: SURF Dine SD2500 and the electrodeposition paint: V-50. The treatments were carried out under the conditions recommended by the maker. The chemical treatment was applied so that the deposition amount of a chemical treatment film might be 2 to 3 g/m$^2$ and the electrodeposition painting was applied with a film thickness of 25μ put on target and at a baking temperature of 170° C. Further, in the salt warm water immersion tests, cut scratches were applied to a sample subjected to chemical treatment and electrodeposition painting beforehand, the sample was immersed in a 5% NaCl solution at 55° C. for 240 hr., a tape exfoliation test was applied to the cut scratch portions, and the maximum exfoliated width at the cut scratch portions was measured and evaluated.

The reason why the invention example is excellent in post-painting corrosion resistance is presumably that: the amount of Si oxide incrassating on a steel sheet surface is suppressed and the dispersion of an Si oxide concentration is decreased by controlling Si on the steel sheet surface in accordance with the aforementioned production conditions for example; and, as a result, the local convergence of corrosion current to low Si oxide concentration portions is alleviated, the partial rise of pH is eliminated, and the dissolution of a chemical film is suppressed. Details are explained below.

Figure 6:
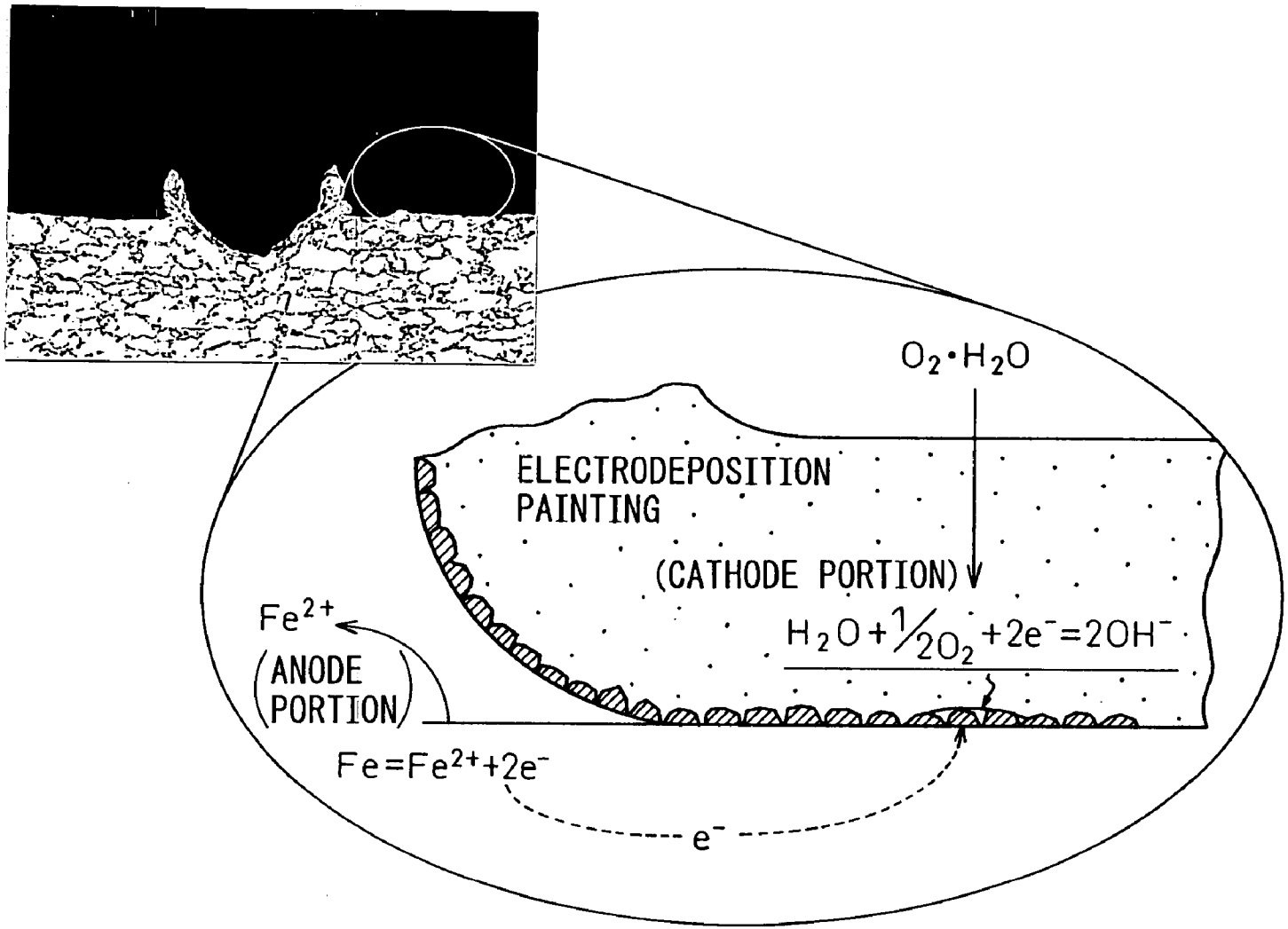
FIG. 6 is an illustration explaining the mechanism of forming alkali blisters.

The mechanism of corrosion in the vicinity of a cut portion in a salt warm water immersion test is called alkali blistering and it is estimated that: $Fe^{2+}$ liquates with metal exposed at a cut portion acting as an anode; a local battery that generates $OH^-$ is formed with a portion under a paint film in the vicinity of the cut portion acting as a cathode; pH is raised by $OH^-$ generated under the paint film; resultantly a chemical film dissolves; water molecules and $Na^{2+}$ intrude by an osmotic pressure; and thus paint film blistering advances (see FIG. 6).

Figure 7:
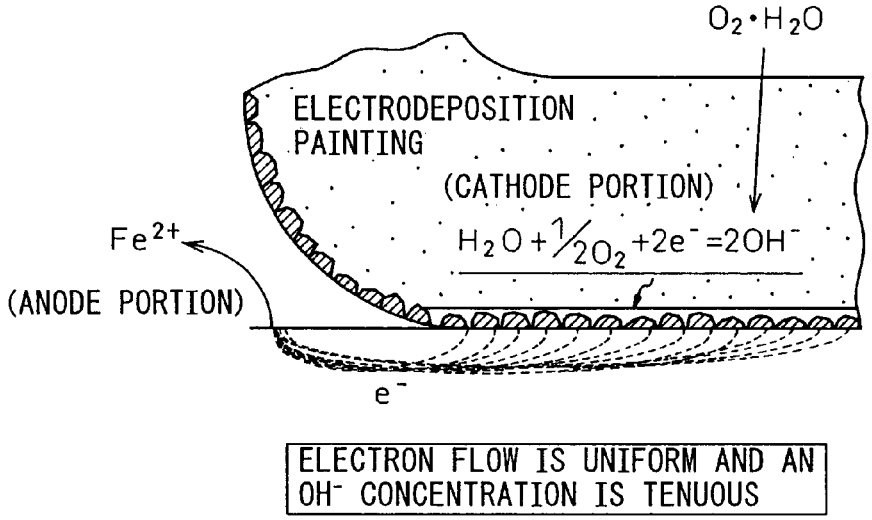
FIG. 7 is an illustration explaining the mechanism of corrosion acceleration by Si incrassating on a surface (ordinary steel, no Si incrassation).

In an ordinary steel sheet, as the ratio of the area of cathode portions to that of cut portions acting as anodes is large and the dispersion of electric resistance of a steel sheet surface is small, corrosion current flows uniformly and $OH^-$ forms uniformly and tenuously (see FIG. 7).

On the other hand, in the case of a TRIP type high-strength steel sheet, as addressed here, Si and Mn are added thereto in high concentrations. It is known that those elements incrassate on the surface of a steel sheet by selective oxidization in an annealing process. However, the elements do not incrassate uniformly on the surface of a steel sheet. According to the investigation by the present inventors, it has been confirmed that Si oxide exists unevenly on the surface of a steel sheet after annealing (see FIGS. 1 to 3).

Figure 8:
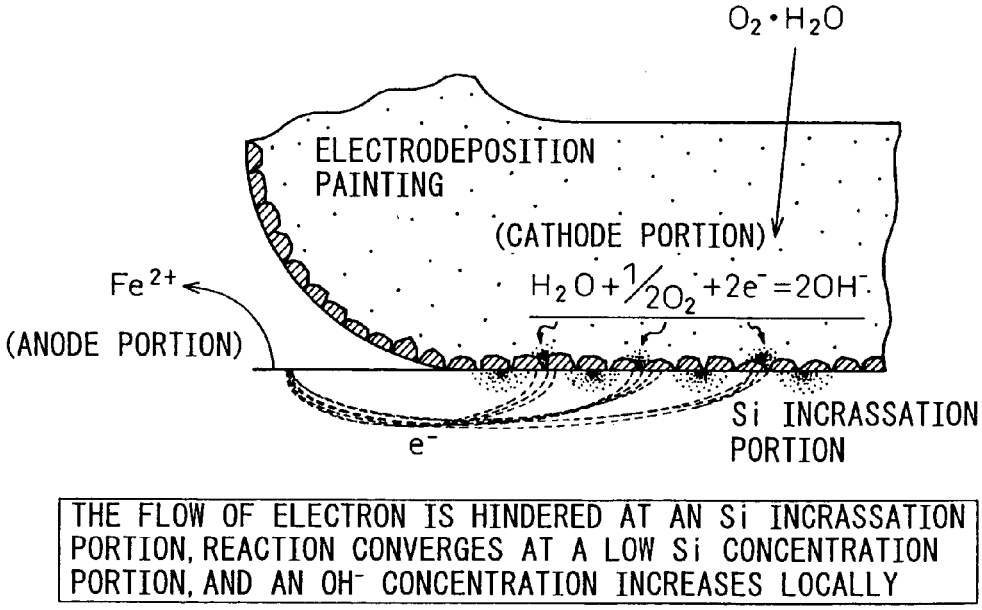
FIG. 8 is an illustration explaining the mechanism of corrosion acceleration by Si incrassating on a surface (poor material, Si incrassating on a surface).

A specific resistance of $SiO_2$, which is a typical Si oxide, is in the order of about the 20th power of 10 times that of iron and the electric resistance of a steel sheet surface varies largely in accordance with the concentration of Si oxide existing on the steel sheet surface. Therefore, at a portion of a high Si oxide concentration, a surface electric resistance is high, thus the flow of corrosion current is hindered, and resultantly the flow of the corrosion current converges at a portion having a low electric resistance and a low Si oxide concentration (see FIG. 8). For that reason, the $OH^-$ concentration at the portion rises, pH rises locally, and a chemical film is dissolved. As a result, the intrusion of water molecules and $Na^{2+}$ is accelerated and, as a result, a paint film exfoliation width, namely a blister width, expands.

Figure 9:
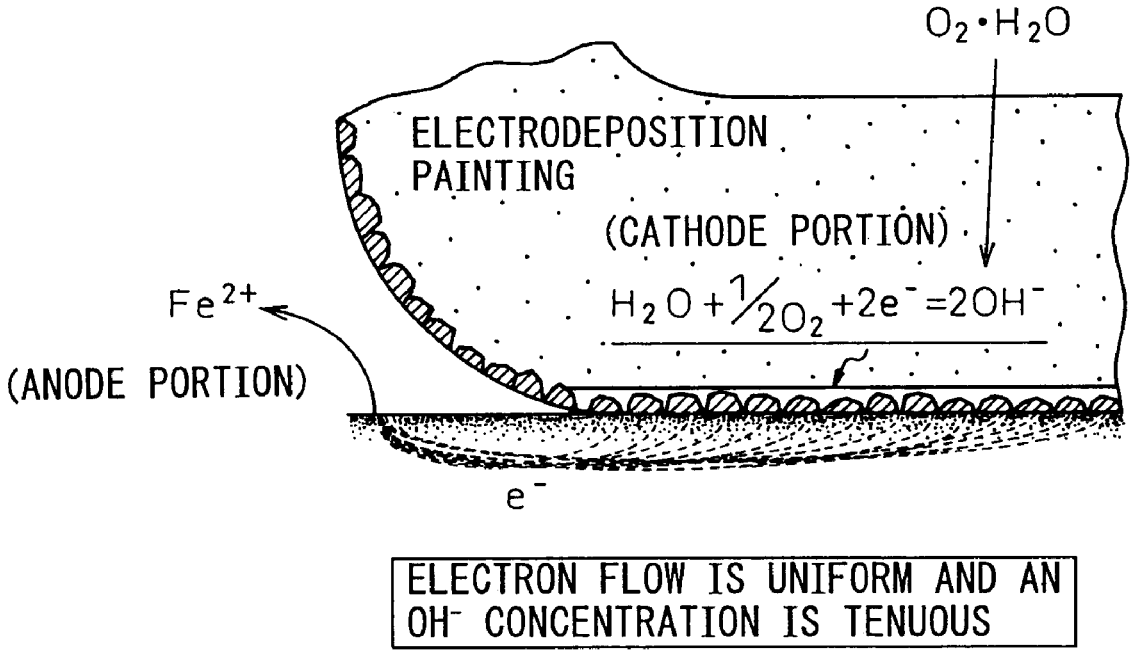
FIG. 9 is an illustration explaining the improvement effect by the decrease and uniformalization of Si incrassating on a surface.

Consequently, it is made possible to prevent the convergence of the corrosion current, to suppress the local rise of pH under a paint film and to decrease a blister width by lowering the Si oxide concentration on a steel sheet surface and uniformalizing the distribution thereof (see FIG. 9).

Further, as a factor influencing corrosion resistance after chemical treatment and electrodeposition painting, Si incrassating in a surface layer that hinders chemical treatment is generally pointed out. The phenomenon is that Si oxide incrassating on a surface hinders the formation of a chemical film, causes the portions where chemical films are not formed, called see-through defects, to be generated, and therefore deteriorates not only paint film adhesiveness but also post-painting corrosion resistance. However, when the present inventors investigated the chemical films of many steel sheets that had poor salt warm water immersion evaluation results in the event of the studies on the present invention, though aforementioned see-through defects were observed on some of the steel sheets, sound chemical films were formed on most of the steel sheets and no difference from ordinary steels having good properties was observed even in terms of a deposit amount that was regarded as an index of the properties of a chemical treatment film, a crystal shape, a crystal size, see-through defects, and a P ratio.

Consequently, to merely form a sound chemical film is insufficient and it is important to control the incrassation of Si oxide on a steel sheet surface and to eliminate the local convergence of corrosion current.

As it has already been explained, the present inventors clarified: the relationship between the incrassation amount and distribution state of Si oxide on a surface and the width of a paint film exfoliating from a cut portion in a salt warm water immersion test; and further the conditions necessary for securing a good salt warm water immersion resistance.

EXAMPLES

Examples of the present invention are shown in Table 1.

Slabs containing chemical components shown in Table 1 were heated to 1,150° C. and 1,260° C. in a reheating furnace, hot-rolled and cold-rolled under ordinary conditions, and thereafter subjected to high-pressure descaling under a discharge pressure of 100 kg/cm$^2$. Subsequently, the resulting cold-rolled steel sheets were subjected to pickling treatment for a dipping time of 20 sec. per one time (in the case of double pickling, two 20 sec. dippings) in a pickling tank containing 9% HCl, and thereafter mechanical descaling. In the mechanical descaling, grinding descaling with brushes containing abrasive grains and tension leveling were applied.

In the implementation of the salt warm water immersion tests, any of a degreasing agent, a surface modifier, a chemical treatment agent and an electrodeposition paint used was a product of Nippon Paint Co., Ltd.; the degreasing agent: SURF Cleaner SD250, the surface modifier: SURF Fine 5N-10, the chemical treatment agent: SURF Dine SD2500 and the electrodeposition paint: V-50. The treatments were carried out under the conditions recommended by the maker. The chemical treatment was applied so that the deposition amount of a chemical treatment film might be 2 to 3 g/m$^2$ and the electrodeposition painting was applied with the film thickness of 25μ on the target and at a baking temperature of 170° C.

Further, in the salt warm water immersion tests, cut scratches were applied to a sample subjected to chemical treatment and electrodeposition painting beforehand, the sample was immersed in a 5% NaCl solution at 55° C. for 240 hr., a tape exfoliation test was applied to the cut scratch portions, and the maximum exfoliated width at the cut scratch portions was measured and evaluated.

An exfoliation width was evaluated by the marks: ◎ for an exfoliation width of less than 2 mm, ○ for the same of 2 to 2.5 mm, and x for the same of more than 2.5 mm, and the marks ◎ and ○ were regarded as acceptable and the mark x as unacceptable.

TABLE 1-1

| | C % | Si % | Mn % | P % | S % | T-Al % | TS-C Mpa | El-G % | Average surface Si incrassation amount (multiple) | Surface Si incrassation distribution index |
|---|---|---|---|---|---|---|---|---|---|---|
| 1 | 0.165 | 1.01 | 1.49 | 0.008 | 0.0018 | 0.025 | 822 | 31 | 42 | 88 |
| 2 | 0.178 | 0.08 | 1.51 | 0.007 | 0.0021 | 0.031 | 810 | 33 | 19 | 71 |
| 3 | 0.176 | 1.18 | 1.58 | 0.011 | 0.0022 | 0.030 | 810 | 31 | 20 | 96 |
| 4 | 0.176 | 1.18 | 1.58 | 0.011 | 0.0022 | 0.030 | 810 | 31 | 18 | 96 |
| 5 | 0.176 | 1.18 | 1.58 | 0.011 | 0.0022 | 0.030 | 810 | 31 | 16 | 82 |
| 6 | 0.176 | 1.18 | 1.58 | 0.011 | 0.0022 | 0.030 | 810 | 31 | 11 | 78 |
| 7 | 0.188 | 1.11 | 1.59 | 0.010 | 0.0019 | 0.028 | 816 | 30 | 35 | 98 |
| 8 | 0.188 | 1.11 | 1.59 | 0.010 | 0.0019 | 0.028 | 816 | 30 | 19 | 97 |
| 9 | 0.188 | 1.11 | 1.59 | 0.010 | 0.0019 | 0.028 | 816 | 30 | 22 | 94 |
| 10 | 0.188 | 1.11 | 1.59 | 0.010 | 0.0019 | 0.028 | 816 | 30 | 16 | 63 |
| 11 | 0.188 | 1.11 | 1.59 | 0.010 | 0.0019 | 0.028 | 816 | 30 | 32 | 69 |
| 12 | 0.182 | 1.29 | 1.56 | 0.011 | 0.0020 | 0.032 | 808 | 32 | 41 | 96 |
| 13 | 0.182 | 1.29 | 1.56 | 0.011 | 0.0020 | 0.032 | 808 | 32 | 18 | 96 |
| 14 | 0.182 | 1.29 | 1.56 | 0.011 | 0.0020 | 0.032 | 808 | 32 | 17 | 94 |
| 15 | 0.182 | 1.29 | 1.56 | 0.011 | 0.0020 | 0.032 | 808 | 32 | 15 | 87 |
| 16 | 0.172 | 1.22 | 1.51 | 0.009 | 0.0021 | 0.027 | 808 | 32 | 38 | 98 |
| 17 | 0.172 | 1.22 | 1.51 | 0.009 | 0.0021 | 0.027 | 808 | 32 | 18 | 98 |

TABLE 1-1-continued

| | C % | Si % | Mn % | P % | S % | T-Al % | TS-C Mpa | El-G % | Average surface Si incrassation amount (multiple) | Surface Si incrassation distribution index |
|---|---|---|---|---|---|---|---|---|---|---|
| 18 | 0.172 | 1.22 | 1.51 | 0.009 | 0.0021 | 0.027 | 808 | 32 | 25 | 93 |
| 19 | 0.172 | 1.22 | 1.51 | 0.009 | 0.0021 | 0.027 | 808 | 32 | 18 | 78 |
| 20 | 0.172 | 1.22 | 1.51 | 0.009 | 0.0021 | 0.027 | 808 | 32 | 15 | 55 |

TABLE 1-2

| | Si condition | Hot-rolling reheating furnace condition | Application or not of high-pressure descaling | Pickling condition: SEHCl | Pickling condition: Application or not of mechanical descaling | Pickling condition: Application or not of double pickling | Salt warm water resistance evaluation | Remarks |
|---|---|---|---|---|---|---|---|---|
| 1 | X | 1250° C. | ○ | ○ | ○ | ○ | X | Comparative example |
| 2 | X | 1260° C. | X | ○ | ○ | ○ | ◎ | Comparative example |
| 3 | ○ | 1150° C. | X | ○ | X | X | X | Comparative example |
| 4 | ○ | 1150° C. | X | ○ | X | ○ | X | Comparative example |
| 5 | ○ | 1260° C. | X | ○ | ○ | X | ◎ | Invention example |
| 6 | ○ | 1260° C. | ○ | ○ | ○ | X | ◎ | Invention example |
| 7 | ○ | 1150° C. | X | ○ | X | X | X | Comparative example |
| 8 | ○ | 1150° C. | X | ○ | X | ○ | X | Comparative example |
| 9 | ○ | 1150° C. | X | ○ | ○ | X | X | Comparative example |
| 10 | ○ | 1260° C. | X | ○ | X | X | ○ | Invention example |
| 11 | ○ | 1260° C. | X | ○ | ○ | ○ | ◎ | Invention example |
| 12 | ○ | 1150° C. | X | ○ | X | X | X | Comparative example |
| 13 | ○ | 1150° C. | X | ○ | X | ○ | X | Comparative example |
| 14 | ○ | 1260° C. | X | ○ | X | ○ | ○ | Invention example |
| 15 | ○ | 1260° C. | ○ | ○ | X | X | ○ | Invention example |
| 16 | ○ | 1150° C. | X | ○ | ○ | X | X | Comparative example |
| 17 | ○ | 1150° C. | X | ○ | ○ | X | X | Comparative example |
| 18 | ○ | 1260° C. | X | ○ | X | X | X | Comparative example |
| 19 | ○ | 1260° C. | X | ○ | ○ | X | ◎ | Invention example |
| 20 | ○ | 1260° C. | ○ | ○ | ○ | ○ | ◎ | Invention example |

As shown in the invention examples of Table 1, it is confirmed that, when a steel sheet contains, in mass, 0.16 to 0.19% C, 1.10 to 1.30% Si, 1.50 to 1.60% Mn, not more than 0.1% P and 0.015 to 0.050% Al, with the balance consisting of Fe and unavoidable impurities, the average of the amount of Si incrassating on the surface of the steel sheet is not more than 20 times the Si concentration in the steel sheet, and the area percentage of the portions where the ratio of the Si concentration on the surface of the steel sheet to the Si concentration in the steel sheet is not less than 10 is not more than 95%, it is possible to secure an excellent salt warm water immersion resistance without the deterioration of the strength and workability of the steel sheet.

The present invention makes it possible to provide a good-workability and high-strength cold-rolled steel sheet excellent in post-painting corrosion resistance to the extent of securing excellent resistance to salt warm water immersion without the deterioration of the strength and workability of the steel sheet.

The invention claimed is:

1. A good-workability and high-strength cold-rolled steel sheet excellent in post-painting corrosion resistance characterized in that: said steel sheet consists essentially of, in mass, 0.172 to 0.19% C, 1.10 to 1.30% Si, 1.50 to 1.60% Mn, not more than 0.1% P and 0.015 to 0.050% Al, with the balance being Fe and unavoidable impurities; the average of the amount of Si incrassating on the surface of said steel sheet is at least 15 and not more than 20 times the Si concentration in said steel sheet; and the area percentage of the portions where the ratio of the Si concentration on the surface of said steel sheet to the Si concentration in said steel sheet is not less than 10 is 55 to 95%; measured at a pitch of 1 μm at 250 points×500 points, using a diameter of a measurement beam of 1 μm; wherein said high-strength cold-rolled steel sheet is a 780 MPa grade high-strength cold-rolled steel sheet.

* * * * *